United States Patent [19]

Switack et al.

[11] 4,030,646

[45] June 21, 1977

[54] SURVIVAL BELT/BAG

[76] Inventors: John Switack; Elva Jane Switack, both of 11 Los Altos Square, Los Altos, Calif. 94022

[22] Filed: Jan. 20, 1975

[21] Appl. No.: 542,193

[52] U.S. Cl. ..... 224/9; 224/26 R; 2/69.5

[51] Int. Cl.[2] ..... A45F 3/00

[58] Field of Search ..... 224/26 R, 26 D, 26 E, 224/26 G, 26 T, 26 H, 21, 22, 23, 11, 12, 9, 26 C; 5/344; 2/69.5, 301, 312; 150/1; 190/2

[56] References Cited

UNITED STATES PATENTS

| | | | |
|---|---|---|---|
| 740,712 | 10/1903 | Tabler | 224/12 |
| 927,839 | 7/1909 | Dennerline | 224/26 C |
| 958,538 | 5/1910 | Ream et al. | 224/26 C |
| 1,486,470 | 3/1924 | Welch | 224/26 C |
| 1,651,921 | 12/1927 | Felz | 224/26 D |
| 1,766,478 | 6/1930 | Baker et al. | 224/26 D |
| 1,920,061 | 7/1933 | Carr | 224/26 H |
| 2,321,808 | 6/1943 | Govan | 224/26 R |
| 2,911,649 | 11/1959 | Ruellé et al. | 2/69.5 |
| 3,074,450 | 1/1963 | Wilkaitis et al. | 150/1 |
| 3,176,315 | 4/1965 | Freund | 5/344 |
| 3,695,507 | 10/1972 | Sams | 150/1 |
| 3,798,676 | 3/1974 | Shanks et al. | 2/69.5 |
| 3,813,716 | 6/1974 | Francis | 5/344 |

*Primary Examiner*—Albert J. Makay
*Assistant Examiner*—Kenneth Noland
*Attorney, Agent, or Firm*—Sabin C. Bronson

[57] ABSTRACT

A survival belt/bag assembly includes a thin single ply non-inflatable, or a multi-layer inflatable wind resistant sleeping bag. The suitably colored or metalized mirror shiny belt/bag serves as a shelter, a ground rescue marker imprinted with survival instructions and maps. A removable head cover, imprinted with specific area maps and survival instructions for the area, also serves as a water bag. The belt buckle contains a mirror, knife, fish line and hooks, matches, whistle and compass.

1 Claim, 15 Drawing Figures

SURVIVAL BELT/BAG

BACKGROUND AND SUMMARY OF THE INVENTION

This invention relates to a survival belt/bag worn normally around one's waist, but instantly available in an emergency. The intent of the invention is to aid man in survival in an unfamiliar or hostile outdoor environment. At times persons become lost while hiking or hunting, or when they stray from camp sites, marked paths or roads. The majority of lost persons are ill prepared for survival, and are thus exposed to the hidden dangers to life. When a person is alone in unfamiliar surroundings, panic may cause him to ignore the common sense rules of safety and survival. Often the lost are inadequately clothed and need food and shelter. Unless panic is restrained, energy vital to survival is uselessly expended, such as in shouting, arm waving and aimless wandering.

A principal purpose of this invention is to improve survival by providing a belt incorporating a sleeping bag imprinted with survival instructions and maps, and suitably colored to serve as a ground rescue marker.

A further object is to provide a removable head cover, imprinted with specific area maps and particularly survival instructions for the area. The head cover also serves as a water bag.

A further object is to provide an air impervious flexible and resilient sheet material such as plastic, rubber or the like, which as a single ply, non-inflatable bag, or a multi-ply bag, which when inflated, can add a measure of insulation against the elements.

A further object is to provide a belt buckle assembly containing a mirror, knife, fish line and hooks, matches, whistle and compass.

A further object is to provide a metalized bag with a mirror shiny surface, to serve as a ground rescue marker in all seasons.

A further object is to provide a belt/bag assembly which can be worn as an ordinary belt or as a supplement thereto during hiking, hunting, fishing, picnicking or the like.

A further object is to provide a sleeping bag not permanently sealed on three of its sides or ends, thus providing a tent-like shelter, or blanket, and doubling the area of the colored ground rescue marker.

A further object is to provide a sleeping bag not permanently sealed on any of its sides or ends, but joined together by snaps or the like, with suitable openings for head, arms and legs, and to be worn during walking as a protective garment and utilizing the head cover as protection against the elements.

Figure 1:
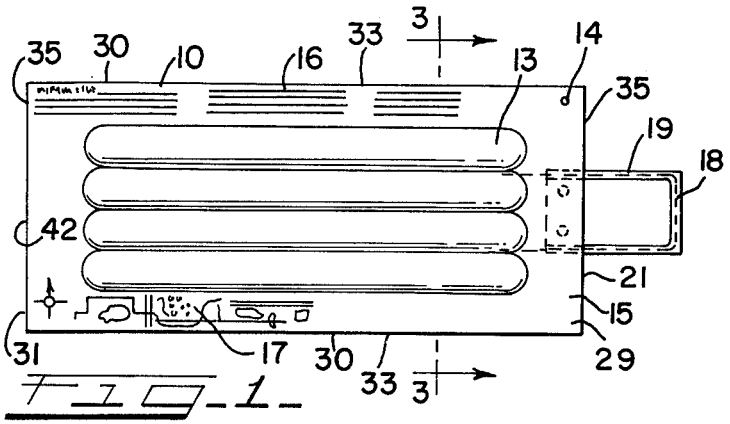
FIG. 1 is a top plan view of the survival belt/bag incorporating the structure of the present invention.
Figure 2:
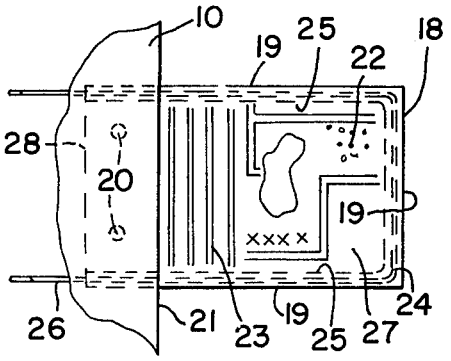
FIG. 2 is an enlarged view of a portion of FIG. 1.
Figure 3:
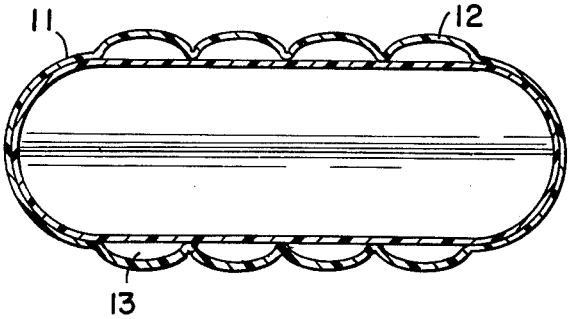
FIG. 3 is a cross sectional view taken on the line 3—3 of FIG. 1.

Referring to the drawings, there is shown a survival belt/bag 10 embodying the structure of the present invention. The belt/bag is made from air imprevious flexible and resilient sheet material such as plastic, rubber or the like. The multi-ply structure 11 includes a ply 12 for a series of air chambers 13. An air valve 14 of substantially conventional structure is suitable for charging and discharging air from the air chambers. In the embodiment the air valve 14 is fixed in a substantially flush position on the outside surface 15. Imprinted on the outside surface 15 are survival instructions 16 and area maps 17. A combination head cover 18 of multi-ply structure made from air impervious flexible and resilient sheet material such as plastic, rubber or the like, with outside edges 19 sealed is affixed in a non-permanent manner such as snaps 20 or the like to the top inside portion 21 of the belt/bag. Imprinted on the outside surfaces of the head cover 18 are specific area maps 22 and instructions 23. The multi-ply 24 of the head cover 18 are fastened together by means of heat sealing 25 or the like to retain string or thong 26 or the like. The purpose of string 26 is to draw head cover 18 snugly around the head against the elements. The main portion 27 of inside of head cover 18 with open end 28 serves as a water bag.

In the embodiment of the present invention the top portion 29 of the belt/bag 10 is open or unsealed to permit entrance of a person's body. The longitudinal ends 30 and bottom 31 are closed by means of heat sealing or the like. In the deflated condition 32 the bag/belt is folded along the longitudinal axis 33 to form a belt 34 to be worn normally or as a supplement around a person's waist or girth. Affixed to each end 35 of belt/bag 10 in the folded condition is a combination buckle survival kit 36. The major storage volume 37 of kit 36 will retain a knife, whistle, compass, fish hooks and line, matches and mirror for survival. The front portion 38 has a polished, mirror-like surface. The lid 39 is spring loaded, biasing the lid in closed position. A spring-like clip 40 extends outwardly from the top of the kit and downwardly for retention of the folded survival belt/bag when worn as a belt.

Figure 4:
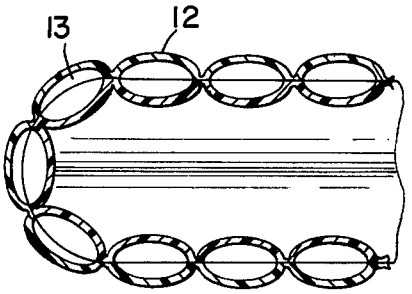
FIG. 4 is a cross sectional view of a survival belt/bag incorporating a modified form of structure of the invention.
Figure 6:
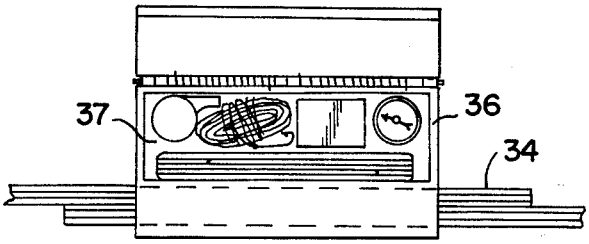
FIG. 6 is a top plan view of a buckle kit with the top open.
Figure 7:
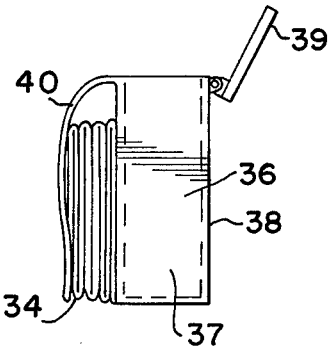
FIG. 7 is an end view of the survival belt/bag kit.
Figure 5:
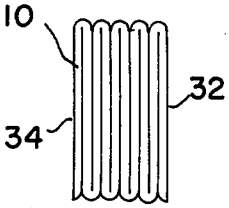
FIG. 5 is an end view of a folded survival belt/bag.
Figure 8:
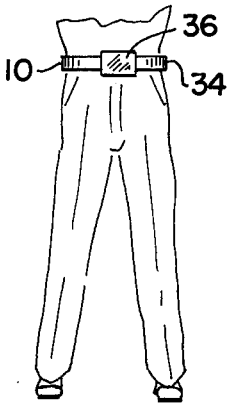
FIG. 8 is a front view of the survival belt/bag worn as a belt.
Figure 9:
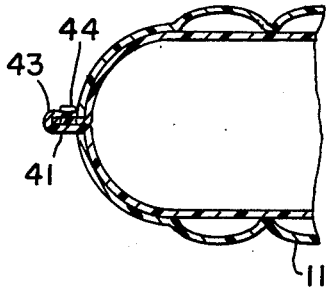
FIG. 9 is a cross sectional view of a survival belt/bag incorporating a further modified structure of the invention.
Figure 10:
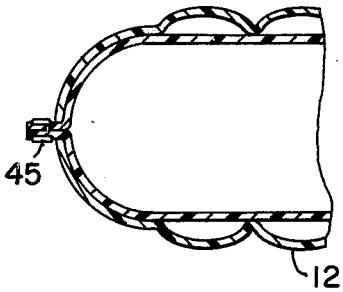
FIG. 10 is a cross sectional view similar to FIG. 9.
Figure 11:
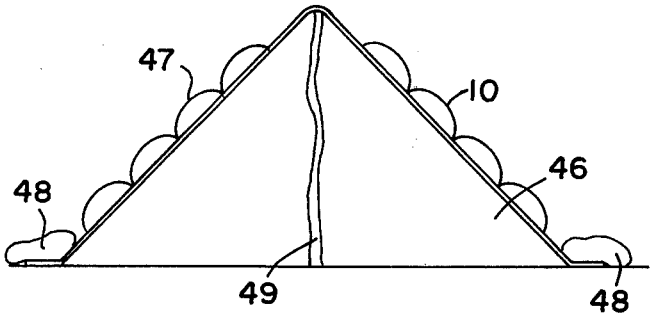
FIG. 11 is an end view of the survival belt/bag utilized as a shelter.
Figure 12:
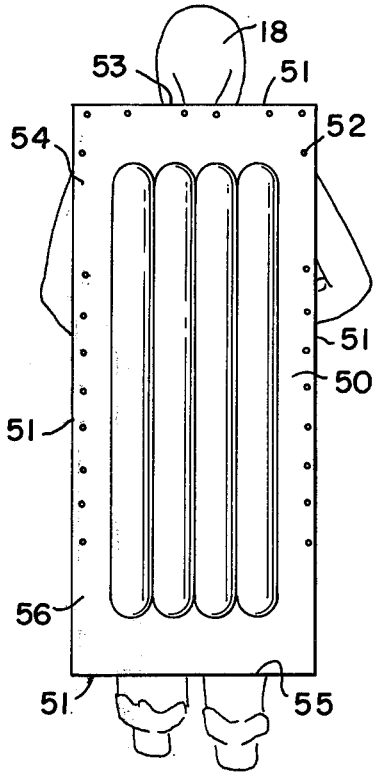
FIG. 12 is a front view of the survival belt/bag worn as a protective garment.
Figure 13:
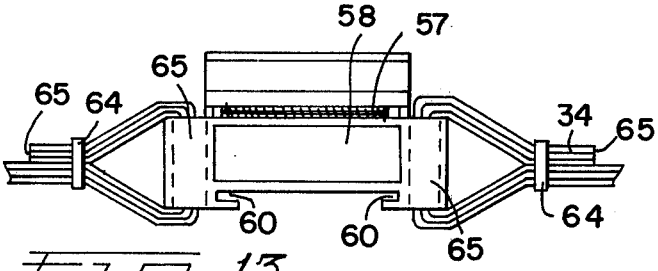
FIG. 13 is a top plan view of a modified form of a kit with the top open.
Figure 14:
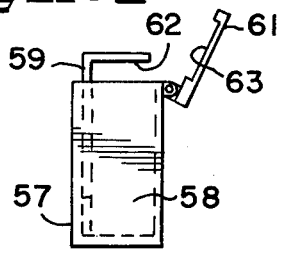
FIG. 14 is an end view of the kit with the top open.
Figure 15:
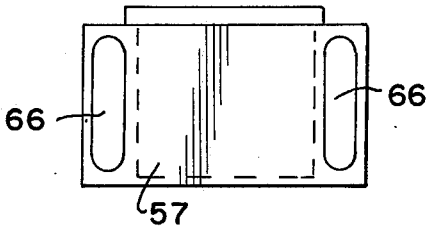
FIG. 15 is a rear view of the kit.

Now referring to the modifications of the invention shown in FIGS. 4, 9, 10, 11, 12, 13, 14 and 15. In these modifications the longitudinal end 41 and bottom 42 are affixed in a non-permanent manner, such as an over-lap 43 with snaps 44 or the like, or by snaps 45 in substantially conventional means. This modification, (FIG. 11), permits belt/bag 10 to be opened as at 46, utilized as a tent-like shelter 47 upheld by materials 48 and 49 indigenous to particular areas and terrain. This modification also permits doubling the area of the belt/bag for a suitably colored ground rescue marker. Also balt/bag 50 (FIG. 12), is not permanently sealed on any of its ends 51 but affixed together by means of snaps 52 or the like, with openings 53, 54 and 55 for head, arms and legs. This modification will function as a protective garment 56, with head cover 18, against the elements during walking. A further modification (FIG. 13) of the invention is a survival kit 57 with major volume 58 for storage of survival items. The mirror 59 (FIG. 14), will be slidably retained within guides 60 of kit 57. A spring loaded lid 61 retains mirror 59 in the fully closed position. A flange 62 is provided on mirror 59 to further insure against loss of the survival items. Longitudinal groove 63 in lid 61 retains flange 62 of mirror 59 in the fully closed position. Slip rings 64 snugly adjust survival belt 34 around a person's waist or girth after ends 65 are looped through openings 66 of survival kit 57.

A further modification to the present invention is a thin single ply non-inflatable belt/bag material embodying all the features described above.

A further modification to the present invention is a thin metallized mirror-like coating on the flexible and resilient sheet material.

What is claimed is:

1. A survival belt/bag adapted to be worn about the waist as a belt or for enclosing a substantial portion of the body when as a bag, comprising impervious flexible, resilient, two-ply inflatable sheet material, foldable longitudinally on spaced fold lines of belt size dimensions, for wearing in the folded condition as a belt, plural air chambers between said fold lines, which may be inflated when unfolded to convert the belt to the bag, wherein it may be worn about the body providing insulation against the elements, and a belt-buckle container for attaching the ends of the folded belt/bag together about a person's waist, said container adapted to carry survival items.

* * * * *